US008165314B2

(12) United States Patent
Sawashi

(10) Patent No.: US 8,165,314 B2
(45) Date of Patent: Apr. 24, 2012

(54) AUDIO OUTPUT APPARATUS AND AUDIO OUTPUT METHOD

(75) Inventor: Tokihiko Sawashi, Tokyo (JP)

(73) Assignee: Sony Corporation (JP)

( * ) Notice: Subject to any disclaimer, the term of this patent is extended or adjusted under 35 U.S.C. 154(b) by 669 days.

(21) Appl. No.: 12/380,367

(22) Filed: Feb. 26, 2009

(65) Prior Publication Data

US 2009/0214050 A1 Aug. 27, 2009

(30) Foreign Application Priority Data

Feb. 26, 2008 (JP) ..... P2008-044822

(51) Int. Cl.
*H04R 3/02* (2006.01)

(52) U.S. Cl. ..... 381/73.1; 381/94.1; 381/317

(58) Field of Classification Search ..... 381/73.1, 381/94.1, 94.2, 94.5, 94.7, 317
See application file for complete search history.

(56) References Cited

U.S. PATENT DOCUMENTS

| | | | | |
|---|---|---|---|---|
| 6,631,197 | B1 * | 10/2003 | Taenzer | 381/316 |
| 7,280,958 | B2 * | 10/2007 | Pavlov et al. | 704/207 |
| 2003/0007648 | A1 * | 1/2003 | Currell | 381/61 |
| 2004/0125922 | A1 * | 7/2004 | Specht | 379/88.01 |

FOREIGN PATENT DOCUMENTS

| | | | |
|---|---|---|---|
| JP | 62171300 | A | 7/1987 |
| JP | 63311807 | A | 12/1988 |
| JP | 05075204 | A | 3/1993 |
| JP | 05175772 | A | 7/1993 |
| JP | 07044415 | A | 2/1995 |
| JP | 07067198 | A | 3/1995 |
| JP | 09148867 | A | 6/1997 |
| JP | 10178695 | A | 6/1998 |
| JP | 2000114899 | A | 4/2000 |
| JP | 2000148161 | A | 5/2000 |
| JP | 2002315091 | A | 10/2002 |
| JP | 2006174083 | A | 6/2006 |
| JP | 2006-222670 | A | 8/2006 |
| JP | 2006222867 | A | 8/2006 |
| JP | 2007-053432 | A | 3/2007 |

OTHER PUBLICATIONS

Office Action from Japanese Application No. 2008-044822, dated Mar. 9, 2010.

* cited by examiner

*Primary Examiner* — Kevin M Picardat

(74) *Attorney, Agent, or Firm* — Lerner, David, Littenberg, Krumholz & Mentlik, LLP

(57) ABSTRACT

An audio output apparatus includes a masking band determining unit configured to determine a first frequency band in which masking due to environmental sounds is likely to occur in audio signal output sounds; a band-component extracting unit configured to extract a signal component from an input audio signal in the first frequency band determined by the masking band determining unit; a pitch shift unit configured to perform pitch shifting of the signal component in the first frequency band extracted by the band-component extracting unit and generate a pitch shift signal containing a signal component of at least a doubled frequency; and a signal output unit configured to supply an audio signal containing the pitch shift signal acquired by the pitch shift unit to a connected speaker.

7 Claims, 10 Drawing Sheets

AUDIO OUTPUT APPARATUS AND AUDIO OUTPUT METHOD

CROSS REFERENCES TO RELATED APPLICATIONS

The present application claims priority from Japanese Patent Application No. JP 2008-044822, filed in the Japanese Patent Office on Feb. 26, 2008, the entire content of which is incorporated herein by reference.

BACKGROUND OF THE INVENTION

1. Field of the Invention

The present invention relates to an audio output apparatus and an audio output method particularly suitable for use in an environment with high levels of exogenous noise.

2. Description of the Related Art

In environments with high levels of exogenous noise, such as inside an automobile, it is often difficult to music and so on.

FIG. 10 illustrates an example in which the noise level inside a traveling automobile is measured. As shown in the drawing, noise having a high level in a low frequency band is generated in a traveling automobile.

When listening to music and so on with an in-vehicle audio system, in particular, low frequencies of the music are masked by such noise.

SUMMARY OF THE INVENTION

When listening to music and so on with an in-vehicle audio system while driving when the level of exogenous noise is high, the user may increase the volume of the music (volume level) to a level similar to the noise, boost the low frequencies by the mechanic function of an equalizer, or carrying out small signal level boosting by compression.

However, since the noise level inside the vehicle increases due to the driving speed, the music signal should be boosted to a level higher than that of the noise in order to prevent masking.

Therefore, the volume level may increase to a level unexpected by the passengers, and thus, it is difficult to ensure a comfortable listening environment.

Accordingly, it is desirable to provide an audio output apparatus and an audio output method that enables music and so on to be enjoyed comfortably even in an environment with high levels of exogenous noise.

An audio output apparatus according to an embodiment of the present invention includes a masking band determining unit configured to determine a first frequency band in which masking due to environmental sounds is likely to occur in audio signal output sounds; a band-component extracting unit configured to extract a signal component from an input audio signal in the first frequency band determined by the masking band determining unit; a pitch shift unit configured to perform pitch shifting of the signal component in the first frequency band extracted by the band-component extracting unit and generate a pitch shift signal containing a signal component of at least a doubled frequency; and a signal output unit configured to supply an audio signal containing the pitch shift signal acquired by the pitch shift unit to a connected speaker.

The band-component extracting unit may separate the signal component of the first frequency band and a signal component of a second frequency band and supply the signal component of the first frequency band to the pitch shift unit, and the signal output unit may supply an audio signal acquired by combining the signal component of the second frequency band and the pitch shift signal to a speaker.

The band-component extracting unit may extract the signal component of the first frequency band from an input audio signal and supply the extracted signal component to the pitch shift unit, and the signal output unit may supply an audio signal acquired by combining the input audio signal and the pitch shift signal to a speaker.

The masking band determining unit may carry out frequency analysis of environmental noise collected by a microphone and carry out determination of the first frequency band on the basis of an environmental noise level of each frequency band.

The pitch shift unit may generate the pitch shift signal containing a signal component of at least a doubled frequency of the frequency of the signal component of the first frequency band and another harmonic component.

An audio output apparatus according to another embodiment of the present invention includes a masking determining unit configured to determine whether or not masking due to environmental sounds occurs to audio signal output sounds; a band-component extracting unit configured to extract a signal component of a specific frequency band from an input audio signal when the masking determining unit determines that masking occurs; a pitch shift unit configured to perform pitch shifting of a signal component in a first frequency band extracted by the band-component extracting unit and generates a pitch shift signal containing a signal component of at least a doubled frequency; and a signal output unit configured to supply an audio signal containing the pitch signal acquired by the pitch shift unit to a connected speaker.

An audio output method according to an embodiment of the present invention includes the steps of determining a first frequency band in which masking due to environmental sounds is likely to occur in audio signal output sounds; extracting a signal component in the first frequency band from an audio signal; performing pitch shifting of the signal component in the extracted first frequency band and generating a pitch shift signal containing a signal component of at least a doubled frequency; and supplying an audio signal containing the pitch shift signal to a connected speaker.

In the embodiments of the present invention, a signal component in a frequency band in an audio signal that is masked by noise is pitch shifted.

For example, when listening to music in a vehicle, in particular, the low frequency band tends to be masked by noise, such as the engine noise and road noise caused during driving. Therefore, clear reproduction under a noise environment is possible by pitch shifting the frequency components of the audio signal of the masked music to a frequency band that is less likely to be masked depending on the noise level and the frequency band.

By pitch shifting the audio signal, the musical pitch changes. However, embodiments of the present invention employ the missing fundamental illusion.

The missing fundamental illusion is a phenomenon in which, for sounds including a harmonic series of the sounds in the fundamental frequency, human beings sense the sounds of the fundamental frequency even when the sounds of the fundamental frequency are not included. Thus, according to the embodiments of the present invention, pitch shifting of signal components of a masked frequency band is performed and the signal components having at least a doubled frequency are set as a pitch shift signal. In other words, the masked band components are moved to a frequency band less likely to be masked, and the user can sense the fundamental frequency components by the output sounds of the pitch shift signal components.

According to embodiments of the present invention, by performing pitch shifting of signal components of a masked frequency band, setting the signal components having at least a doubled frequency as a pitch shift signal, and outputting an audio signal containing the pitch shift signal components to a speaker, sounds in a frequency band that is not heard due to a masking effect can be sensed by users through harmonic components that are less likely to be masked, and the sounds of the masked frequency band can be sensed by the missing fundamental illusion.

In this way, the effect of masking due to noise can be reduced, and, even under high-noise conditions, music and so on can be enjoyed without increasing the output volume of the music and so on or by boosting the frequency band being masked.

In-vehicle audio apparatuses according to first, second, and third embodiments of the present invention will be described below.

DESCRIPTION OF THE PREFERRED EMBODIMENTS

First Embodiment

Figure 1:
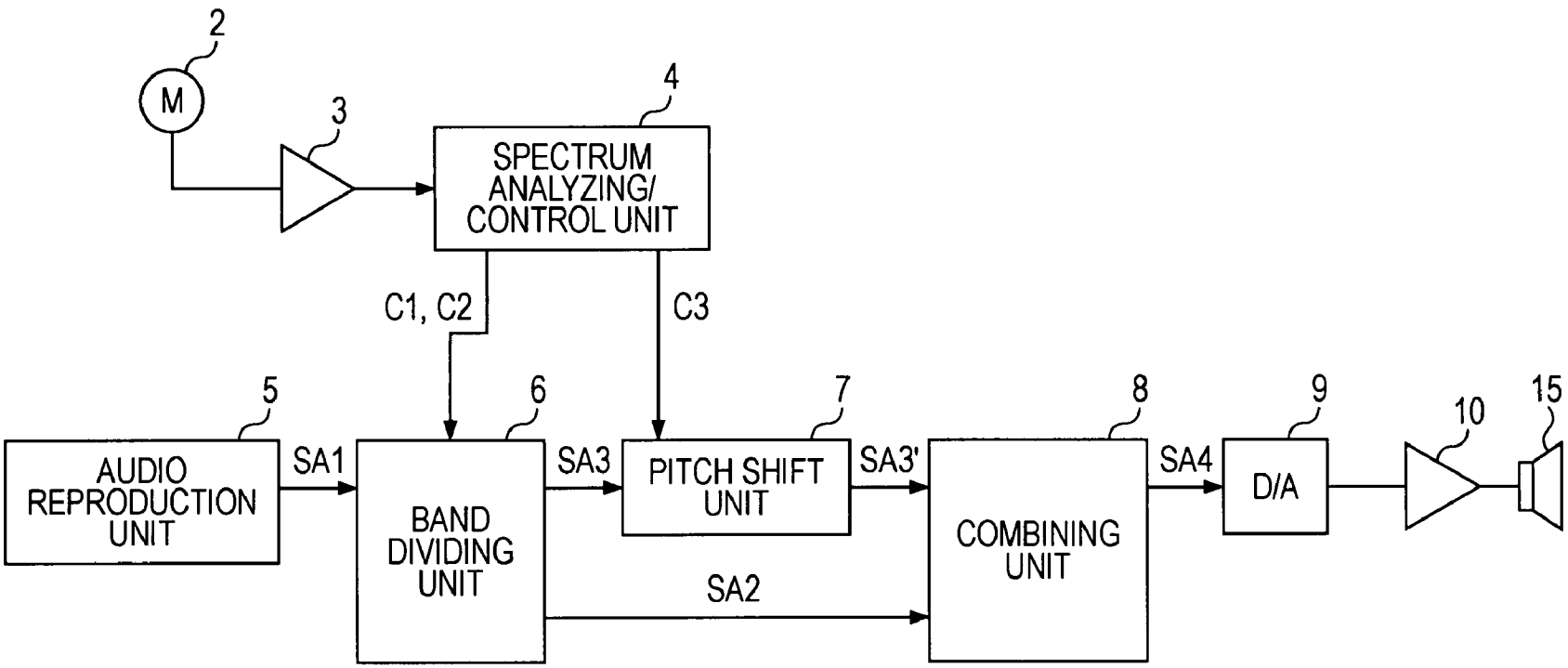
FIG. 1 is a block diagram of an audio apparatus according to a first embodiment of the present invention.

FIG. 1 illustrates an in-vehicle audio apparatus 1 according to the first embodiment of the present invention.

The audio apparatus 1 includes a microphone 2, a microphone amplifier 3, a spectrum analysis/control unit 4, an audio reproduction unit 5, a band dividing unit 6, a pitch shift unit 7, a combining unit 8, a D/A converter 9, a power amplifier 10, and a speaker 15.

The microphone 2 is used to collect noise sensible inside the vehicle, i.e., road noise, and is installed in an appropriate location inside an automobile.

Noise audio signals acquired by the microphone 2 are supplied to the spectrum analysis/control unit 4 via the microphone amplifier 3.

The spectrum analysis/control unit 4 performs spectrum analysis of the input noise audio signal and detects the level of each frequency band. As described below, the spectrum analysis/control unit 4 also controls the operation of the band dividing unit 6 and the pitch shift unit 7 in accordance with the detected result.

The audio reproduction unit 5 is, for example, an optical disk reproduction unit, a hard disk drive (HDD), a memory card drive, or a magnetic tape player. In other words, the audio reproduction unit 5 is a section that reproduces an audio signal SA1, such as music content, on a recording medium, such as an optical disk, a hard disk, a memory card, or a magnetic tape.

The audio signal SA1 output from the audio reproduction unit 5 a digital audio signal. However, the audio signal SA1 may otherwise be an analog audio signal.

In this embodiment, the audio reproduction unit 5 is the audio source of the audio signal SA1. However, this is merely an example, and so long as the audio source is a section that outputs the audio signal SA1, it may not necessarily be a reproduction unit of recording medium. The audio reproduction unit 5 may instead be an audio output system, such as a radio tuner, a television tuber, or a video reproduction unit.

To simplify the description, only one circuit system (band dividing unit 6, pitch shift unit 7, combining unit 8, D/A converter 9, power amplifier 10, and speaker 15) corresponding to an audio signal SA is described. However, for a stereo system, two of these systems are provided. When a multi channel system is employed, a similar configuration is provided for each channel. Alternatively, the configuration shown in FIG. 1 may be provided for some of the channels in the multi channel system.

The band dividing unit 6 performs band division on the audio signal SA1 from the audio reproduction unit 5 and outputs band-division audio signals SA2 and SA3. One of the divided bands is supplied to the pitch shift unit 7 as the audio signal SA3 of a frequency band subjected to pitch shift processing.

Figure 2:
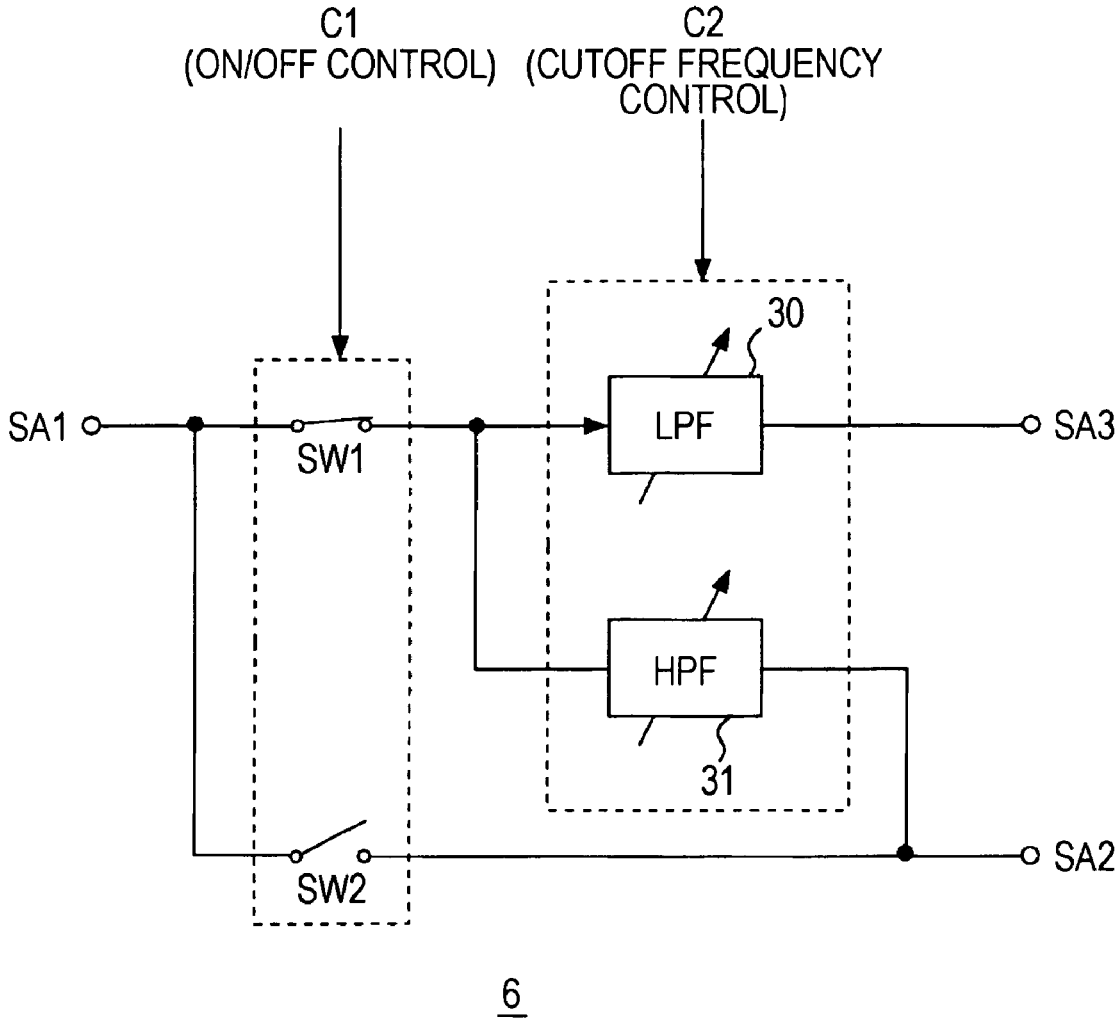
FIG. 2 is a block diagram of a band dividing unit according to an embodiment.

As shown in FIG. 2, the band dividing unit 6 includes switches SW1 and SW2, a bandpass tunable low-pass filter (LPF) 30, a bandpass tunable high-pass filter (HPF) 31.

The switches SW1 and SW2 are turned on or off by a control signal C1 form the spectrum analysis/control unit 4. In this case, only one of the switches SW1 and SW2 is turned on.

The cutoff frequencies of the bandpass tunable LPF 30 and the bandpass tunable HPF 31 are controlled in an interlocking manner by a control signal C2 from the spectrum analysis/control unit 4.

As shown in FIG. 2, when the switch SW1 is turned on and the switch SW2 is turned off, the audio signal SA1 is supplied to the bandpass tunable LPF 30 and the bandpass tunable HPF 31. When the cutoff frequency of the bandpass tunable LPF 30 and the bandpass tunable HPF 31 is controlled to 100 Hz by the control signal C2, signal components of a frequency band of 100 Hz or lower are extracted at the bandpass tunable LPF 30, and these signal components are output to the pitch shift unit 7 as the audio signal SA3 of a frequency band subjected to pitch shift processing. At the bandpass tunable HPF 31, signal components of a frequency band of 100 Hz or higher pass. These signal components are output as the audio signal SA2 and are supplied to the combining unit 8.

Alternatively, when the switch SW1 is turned off and the switch SW2 is turned on, the audio signal SA1 is output as the audio signal SA2 without being divided. In such a case, an audio signal SA2 for the pitch shift unit 7 is not output.

When such a configuration is employed, the band dividing unit 6 outputs the audio signal SA2 and SA3, as shown in FIG. 1.

The audio signal SA3 output from the band dividing unit 6 is input to the pitch shift unit 7. The pitch shift unit 7 performs pitch shift of the audio signal SA3 and outputs a pitch shift signal SA3' including signal components of at least a doubled frequency.

Figure 3:
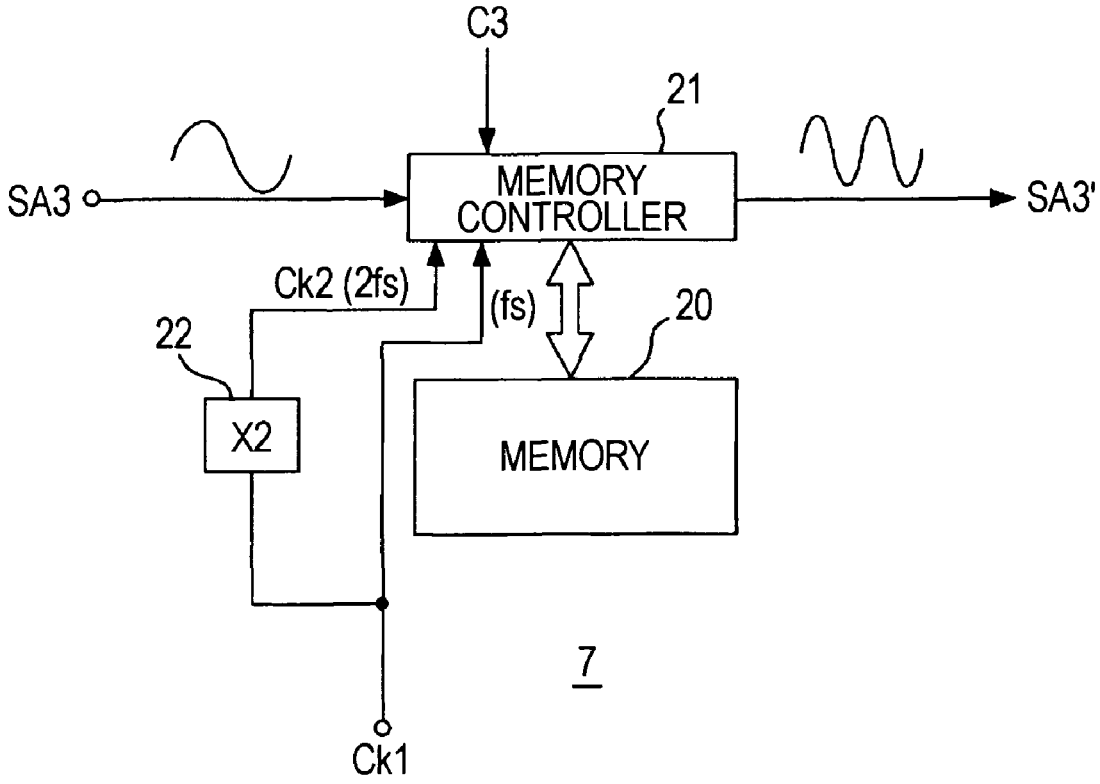
FIG. 3 is a block diagram of a pitch shift unit according to an embodiment.

An example configuration of the pitch shift unit 7 is illustrated in FIG. 3. For example, the pitch shift unit 7 includes a memory 20, a memory controller 21, and a multiplier 22. The memory 20 is, for example, a dynamic random access memory (DRAM), a synchronous dynamic random access memory (SDRAM), which is a type of DRAM, or a static random access memory (SRAM).

The memory controller 21 is provided with a clock signal CK1 having a frequency fs as a writing clock signal. The clock signal CK1 is doubled at the multiplier 22 to generate a clock signal CK2 having a frequency (2fs), and this clock signal CK2 is supplied to the memory controller 21 as a reading clock signal.

The memory controller 21 writes the input audio signal SA3 in the memory 20 according to the clock signal CK1. The memory controller 21 reads out the audio signal SA3 written in the memory 20 two consecutive times at each predetermined unit according to the doubled clock signal CK2. By outputting the readout signal consecutively, the audio signal SA3 can be output as a pitch shift signal SA3' having a doubled frequency. In other words, a pitch shift signal SA3' in which the fundamental pitch components included as the audio signal SA3 are second harmonic overtones is output.

The memory controller 21 performs such a pitch shifting operation on the basis of a control signal C3.

As shown in FIG. 1, the pitch shift signal SA3' output from the pitch shift unit 7 and the audio signal SA2 from the band dividing unit 6 are supplied to the combining unit 8.

The combining unit 8 additively combines the pitch shift signal SA3' and the audio signal SA2 to generate an audio signal SA4 to be supplied to the speaker 15.

The audio signal SA4 is amplified at the power amplifier 10 after being converted into an analog audio signal at the D/A converter 9 and is output from the speaker 15 as sound, i.e., reproduced sound, such as music.

With reference to the configuration shown in FIG. 1, the correspondence between the features of the claims and the specific elements disclosed in an embodiment of the present invention is as follows:

masking band determining unit: spectrum analysis/control unit 4 band-component extracting unit: band dividing unit 6 pitch shift unit: pitch shift unit 7 signal output unit: combining unit 8

The operation of the audio apparatus 1 will be described.

Figure 10:
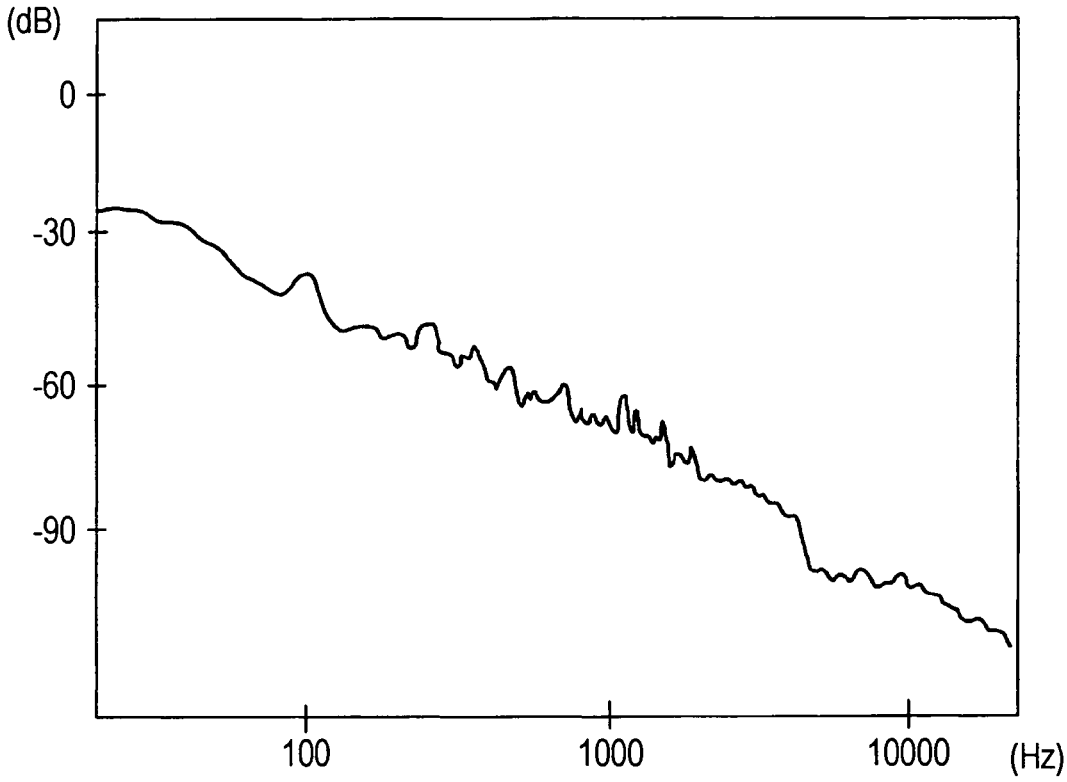
FIG. 10 illustrates the noise measurement result of a vehicle interior.

As shown in FIG. 10, the level of vehicle interior noise generated during driving is high in at low frequency and low at high frequency. Therefore, music signal components at low frequency tend to be masked by the driving noise. In this embodiment, to prevent such masking, the vehicle interior noise is collected by the microphone 2, and the low frequency bands are appropriately shifted to frequencies less likely to be masked.

Figure 4:
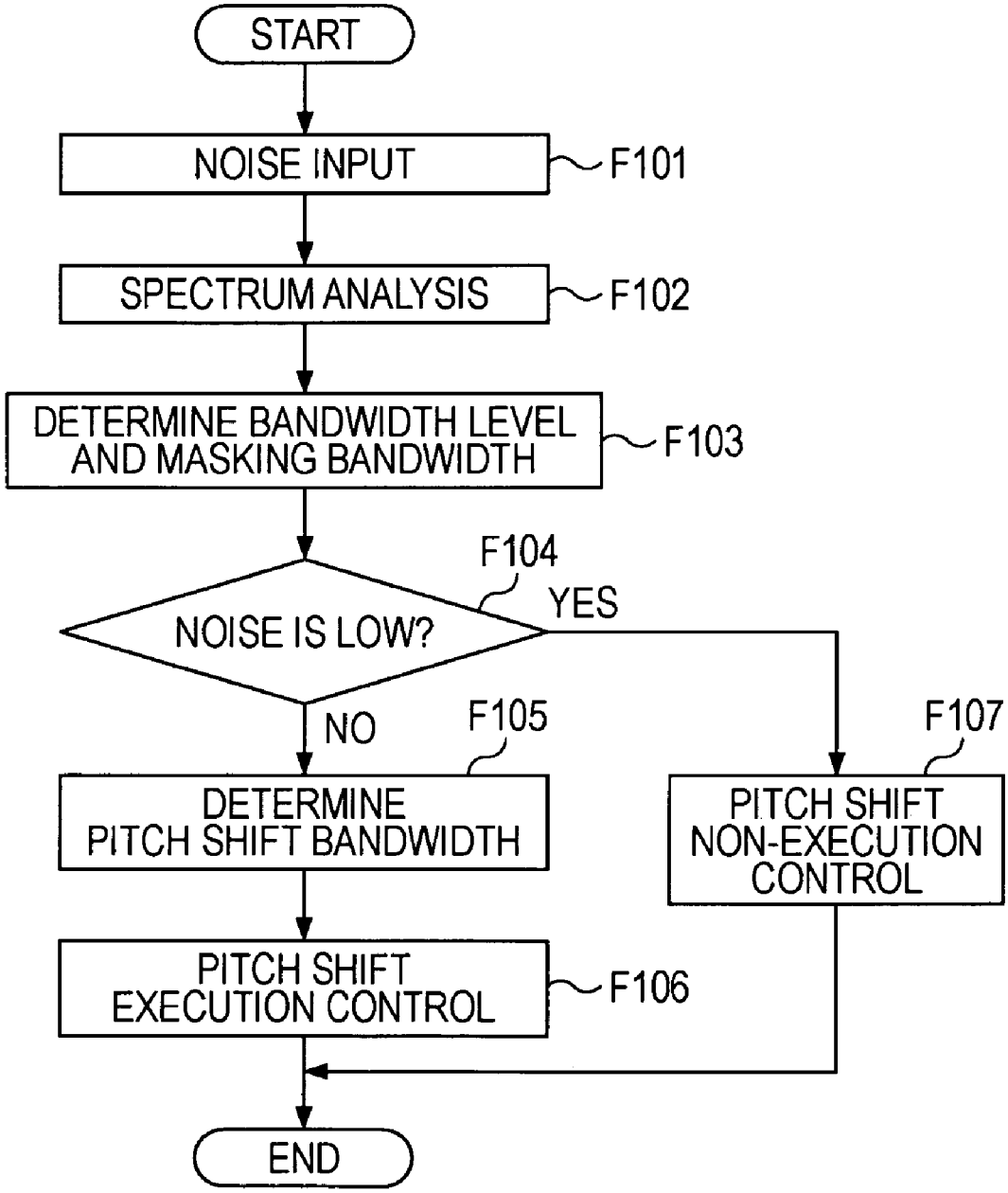
FIG. 4 is a flow chart illustrating the processing carried out by a spectrum analysis/control unit according to an embodiment.

The processing for this operation performed by the spectrum analysis/control unit 4 is illustrated in FIG. 4. FIG. 5 is a schematic view of an image of the operation process corresponding to the process shown in FIG. 4.

The process illustrated in FIG. 4 is carried out repeatedly by the spectrum analysis/control unit 4 while music and so on from the audio reproduction unit 5 is reproduced by the audio apparatus 1.

In Step F101, noise is input to the spectrum analysis/control unit 4. In other words, a noise audio signal is input to the spectrum analysis/control unit 4 via the microphone 2 and the microphone amplifier 3.

In Step F101, the spectrum analysis/control unit 4 performs spectrum analysis of the input noise audio signal in predetermined units. In Step F103, as a result of the spectrum analysis, the level of each frequency band is detected and a frequency band in which masking of the reproduced music is more likely to occur is determined.

For example, the probability of masking may be determined by comparing the noise level in each frequency band to a predetermined threshold level th.

Figure 5A:
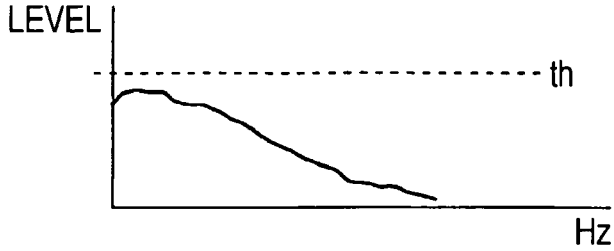
FIG. 5 is a schematic view of an operation image according to an embodiment.
Figure 5B:
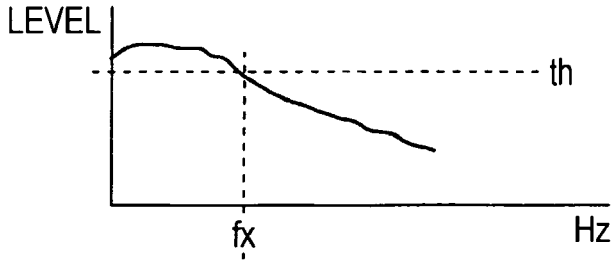

FIGS. 5A and 5B illustrate examples of the results of noise spectrum analysis. In FIG. 5A, the noise level is below the threshold level th even in the low frequency band, and thus, it is determined that masking will not occur. This, for example, corresponds to a case in which the vehicle is not driving, and thus the noise level is low.

On the other hand, FIG. 5B illustrates a case in which road noise is great due to an increase in driving speed. The noise exceeds the threshold level th in the low frequency band. When a noise level exceeding the threshold level th is detected, it is determined that masking of the speaker output sound is likely to occur.

As a result of the determination, if the noise level is low, as shown in FIG. 5A, and masking is less likely to occur, the spectrum analysis/control unit 4 proceeds from Step F104 to Step F107 and carries out pitch shift non execution control.

In other words, in such a case, the control signal C1 turns on the switch SW1 of the band dividing unit 6, which is shown in FIG. 2, turns on the switch SW2, and does not allow the pitch shift unit 7 to carry out a pitch shifting operation by the control signal C3.

Therefore, in this case, the audio signal SA1 from the audio reproduction unit 5 is directly supplied to the combining unit 8 as the audio signal SA2, which is not divided by the band dividing unit 6. The pitch shift signal SA3' is not input to the combining unit 8.

The combining unit 8 directly outputs the audio signal SA2 (=SA1) as the audio signal SA4 (i.e., SA4=SA1) for speaker output. Therefore, in such a case, the audio signal SA1 from the audio reproduction unit 5 is directly output from the speaker.

As shown in FIG. 5B, when the road noise level is high and masking is likely to occur, the spectrum analysis/control unit 4 proceeds from Step F104 to F105. In Step F105, the frequency band to which pitch shifting is to be carried out is determined.

For example, in FIG. 5B, if a noise level exceeding the threshold level th is observed in a frequency band below a frequency fx, the frequency band below the frequency fx is selected as the frequency band to which pitch shifting is carried out.

Then, pitch shift execution control is carried out in Step F106 to the selected frequency band.

In other words, in such a case, the control signal C1 turns on the switch SW1 of the band dividing unit 6, which is shown in FIG. 2, and turns off the switch SW2. The control signal C2 sets a cutoff frequency to fx. Moreover, the control signal C3 instructs the pitch shift unit 7 to execute the pitch shifting operation.

An image of an audio signal in such a case is illustrated in FIGS. 5C, 5D, 5E, and 5F.

Figure 5C:
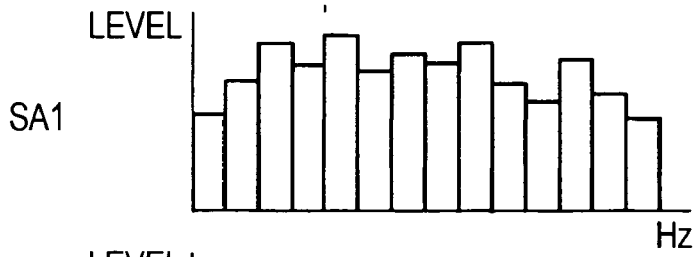

The audio signal SA1 from the audio reproduction unit 5 is illustrated in FIG. 5C along a frequency axis.

Figure 5D:
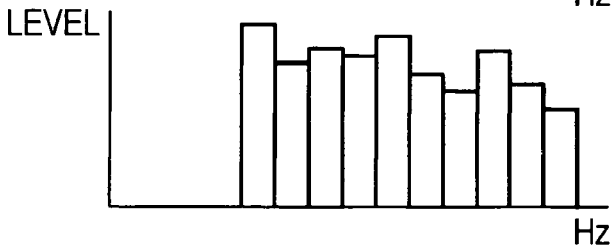
Figure 5E:
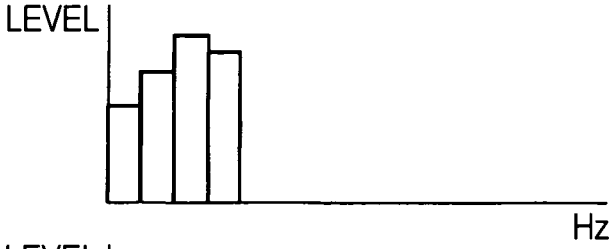

In such a case, signal components of the frequency band above a frequency fx shown in FIG. 5D are output as the audio signal SA2 from the band dividing unit 6, and the signal components of a frequency band below the frequency fx shown in FIG. 5E are supplied to the pitch shift unit 7 as the audio signal SA3.

Figure 5F:
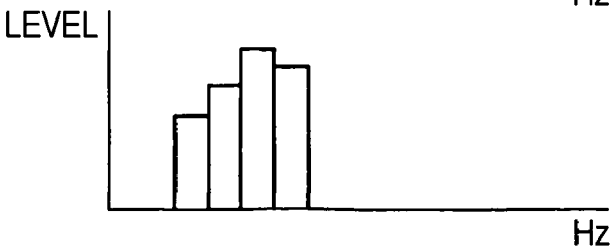

The pitch shift unit 7 carries out pitch shifting processing on the audio signal SA3 and outputs the pitch shift signal SA3' including signal components shown in FIG. 5F.

At the combining unit 8, the audio signal SA2 of FIG. 5D and the pitch shift signal SA3' of FIG. 5F are additively combined, and the result is output to the speaker 15 as the audio signal SA4 (SA4=SA2+SA3').

For example, if the frequency fx is 100 Hz, signal components in a frequency band equal to and below 100 Hz is pitch shifted to a doubled frequency. The pitch shifted components are added to the signal components in a frequency band equal to and above 100 Hz and are output to the speaker 15.

By carrying out the processing according to this embodiment, the masking effect due to noise can be reduced. Accordingly, even under a high-noise conditions, such as inside a driving vehicle, music and so on can be enjoyed without increasing the output volume of the music and so on reproduced by the audio reproduction unit 5 or by boosting the frequency band being masked.

In other words, by pitch shifting signal components in the audio signal SA1 in the frequency band masked by noise, the signal components in the frequency band, i.e., the signal components that are not heard by listeners due to masking, are shifted to a frequency band that is less likely to be masked. Thus, the audio output after carrying out pitch shifting can be heard by the users.

When the audio signal components, for example, signal components of 100 Hz, are pitch shifted to 200 Hz, masking may be prevented, but the pitch of the signal components may change. However, due to the missing fundamental illusion, the user will sense the music and so on normally.

According to the related art, the missing fundamental illusion is a phenomenon in which, for sounds including a harmonic series of the sounds in the fundamental frequency, human beings sense the sounds of the fundamental frequency even when the sounds of the fundamental frequency are not included. Even when components of the fundamental frequency (for example, 100 Hz) are not included, human beings sense the fundamental frequency (100 Hz) if the second harmonic overtone (200 Hz) is included. Due to this phenomenon, even when pitch shifting is performed as described in this embodiment, the image of the original music and so on is not lost. Therefore, the effect of masking due to noise can be reduced, and music and so on can be enjoyed. In particular, the low frequency band that is masked can be clearly heard. In this way, an increase in the speaker output volume is unnecessary.

In this embodiment, the pitch shift unit 7 carries out pitch shift to a doubled frequency.

In order to sense the fundamental frequency under the missing fundamental illusion, at least a second harmonic overtone of the fundamental frequency should be present, and it is preferable that a harmonic series including, for example, a third harmonic overtone and a fourth harmonic over tone be present. As described above, when the audio signal is music, the audio signal contains a harmonic series. In other words, since, not only the pitch shift signal SA3', which is the second harmonic overtone, is output, but also the audio signal SA2 is mixed and output, the final speaker output includes, in addition to the high level second harmonic overtone, components of a harmonic series is included. Therefore, the user can sense the fundamental frequency.

The pitch shift signal SA3' may not only contain the second harmonic overtone but also other components of the harmonic series.

Figure 6:
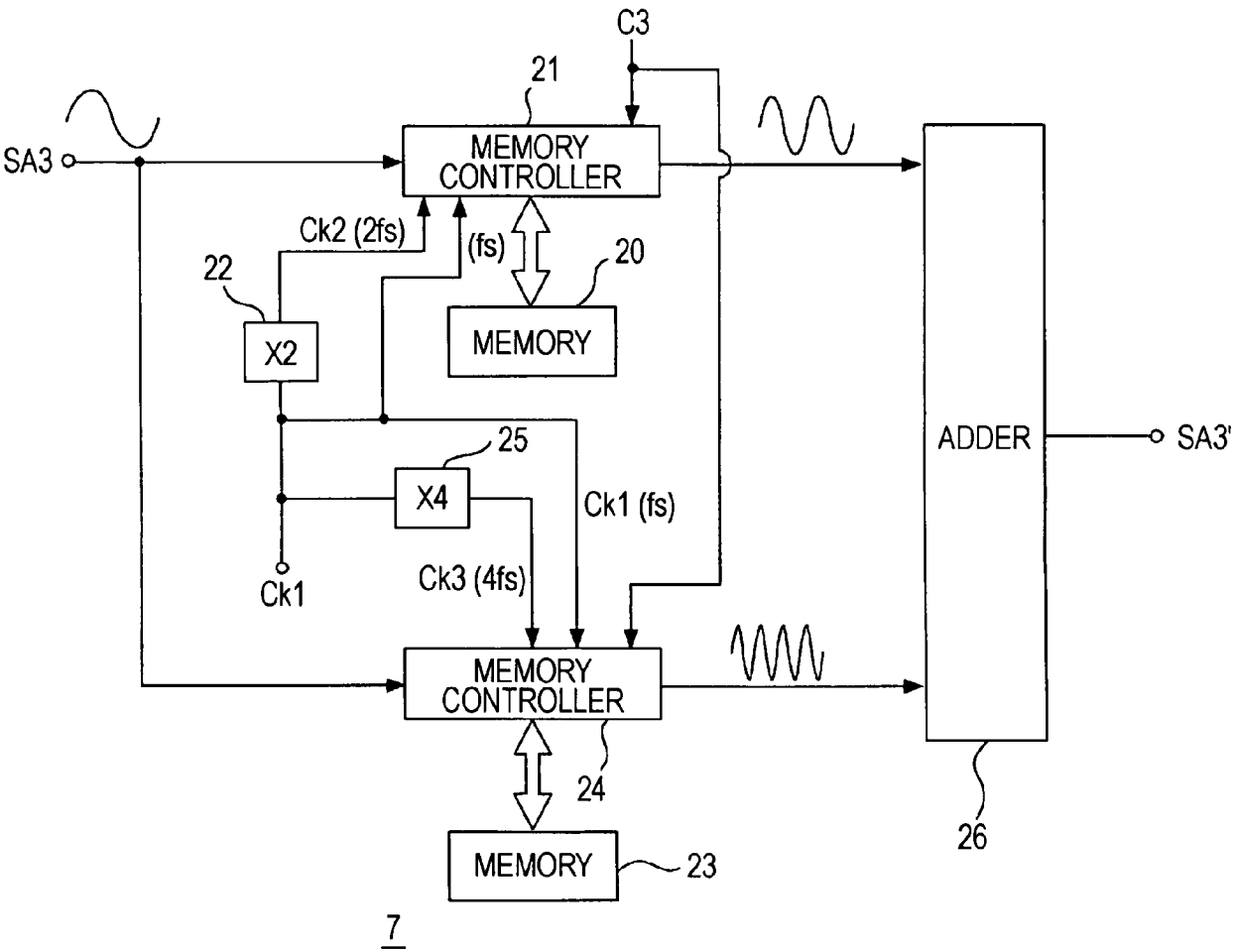
FIG. 6 is a block diagram of a pitch shift unit according to an embodiment.

For example, the pitch shift unit 7 may be constructed in such a manner illustrated in FIG. 6. The pitch shift unit 7 includes, in addition to the memory 20, the memory controller 21, and the multiplier 22 shown in FIG. 3, a memory 23, a memory controller 24, a multiplier 25, and an adder 26.

The clock signal CK1 having the frequency fs is supplied to the memory controller 24 as a writing clock signal, and the clock signal CK2, which is acquired by multiplying the clock signal CK1 by four to a frequency (4fs) at the multiplier 25, is supplied as a reading clock signal.

The memory controller 21 writes the input audio signal SA3 on the memory 20 according to the clock signal CK1 and reads out, at every predetermined unit, the audio signal SA3 written on the memory 20 two consecutive times according to the clock signal CK2 having a doubled frequency. In this way, a signal acquired by pitch shifting the audio signal SA3 to a doubled frequency is output.

The memory controller 24 writes the audio signal SA3 on the memory 23 according to the clock signal CK1 and reads out, at every predetermined unit, the audio signal SA3 written on the memory 23 four consecutive times according to the clock signal CK3. In this way, a signal acquired by pitch shifting the audio signal SA3 to quadrupled frequency is output.

The adder 26 adds the signal pitch shifted to a double frequency and the signal pitch shifted to a quadrupled frequency and outputs the added signals as the pitch shift signal SA3'.

In this way, not only a second harmonic overtone but also other harmonic series components may be actively added to the pitch shift signal SA3'.

Third, fifth, and/or sixth harmonic overtones may be included in the pitch shift signal SA3'.

In this embodiment, the microphone 2 is configured to collects noise and not to collect sound, such as the reproduced music, based on the audio signal SA1.

It is desirable to configure the microphone 2 such that the sounds output from the speaker 15 are less likely to be collected by selecting an appropriate installation site and orientation of the microphone 2 in the vehicle.

Alternatively, since road noise is mainly in a low frequency band, for example, 200 Hz or lower, the low frequency components of 200 Hz or lower of the audio signal collected at the microphone 2 may be supplied to the spectrum analysis/control unit 4.

Moreover, the audio signal SA1 from the audio reproduction unit 5 is phase-reversed and supplied to the spectrum analysis/control unit 4 as a reversed phase signal. By adding the reversed phase signal to the audio signal collected at the microphone 2 and cancel out the components of the audio signal SA1, the road noise components may be analyzed at the spectrum analysis/control unit 4.

Masking is determined at the spectrum analysis/control unit 4 by comparing the noise level at each frequency band with a predetermined threshold level th. The threshold level th may be the same level for each frequency band, or different threshold levels th may be set for each frequency band.

The threshold level th for masking determination may be variable according to the volume of the audio signal output from the speaker 15.

The audio signal SA1 from the audio reproduction unit 5 may be supplied to the spectrum analysis/control unit 4, and the level of the audio signal SA1 may be detected for each frequency band in a similar manner as for noise. Then, the noise level of each frequency level and the audio signal level may be compared to detect whether masking occurs and in which frequency band masking occurs.

In FIG. 1, the audio signal SA1 is a digital audio signal. However, the audio signal SA1 may be an analog audio signal, and the band dividing unit 6, the pitch shift unit 7, the combining unit 8, and so on may carry out processing for analog audio signals.

Although not repeated, the above-described aspects, i.e., a pitch shift signal SA3' containing many harmonic components, detection method of noise by the microphone 2, masking determination method, and convertibility of digital processing and analog processing of an audio signal, can be employed in second and third embodiments described below.

Second Embodiment

Figure 7:
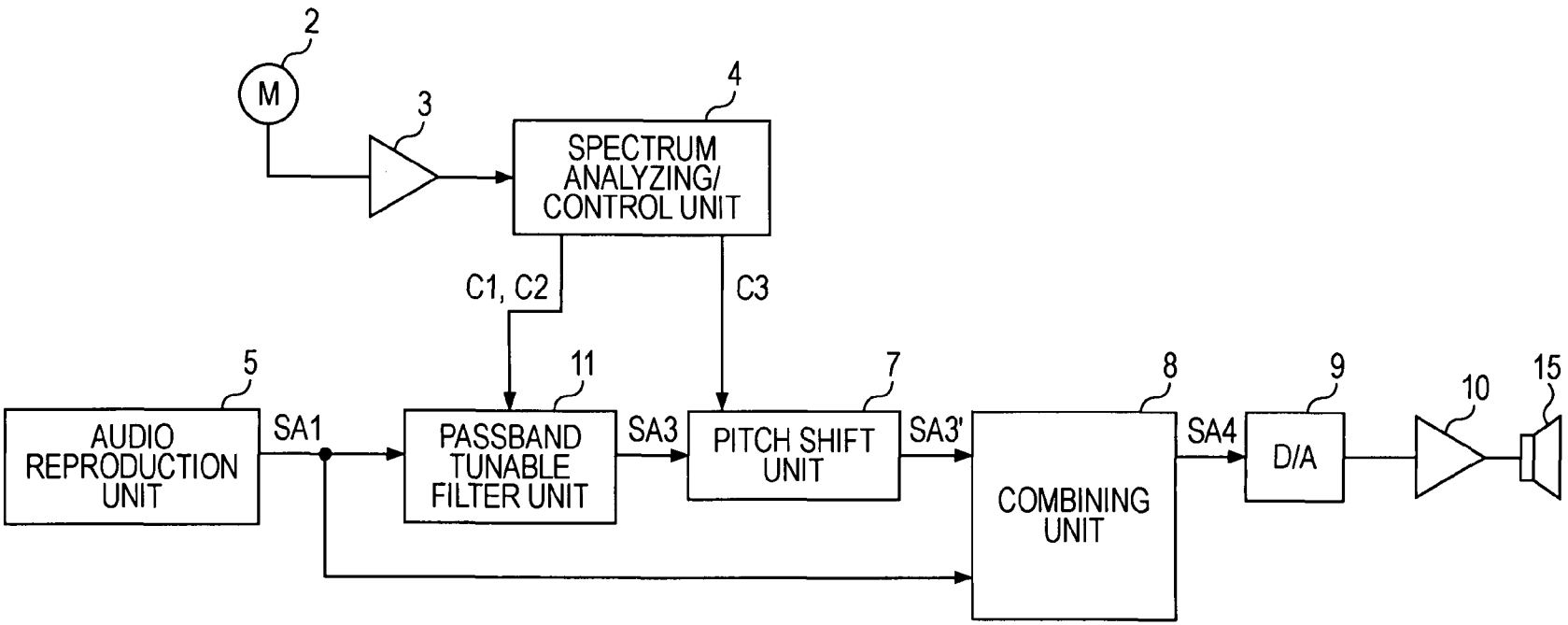
FIG. 7 is a block diagram of an audio apparatus according to a second embodiment of the present invention.

The configuration of an audio apparatus 1 according to a second embodiment is illustrated in FIG. 7. The components that are same as those in FIG. 1 will be indicated by the same reference numerals, and descriptions thereof will not be repeated.

In such a case, an audio signal SA1 from an audio reproduction unit 5 is directly supplied to a combining unit 8 and is supplied to a bandpass tunable filter unit 11.

Figure 8:
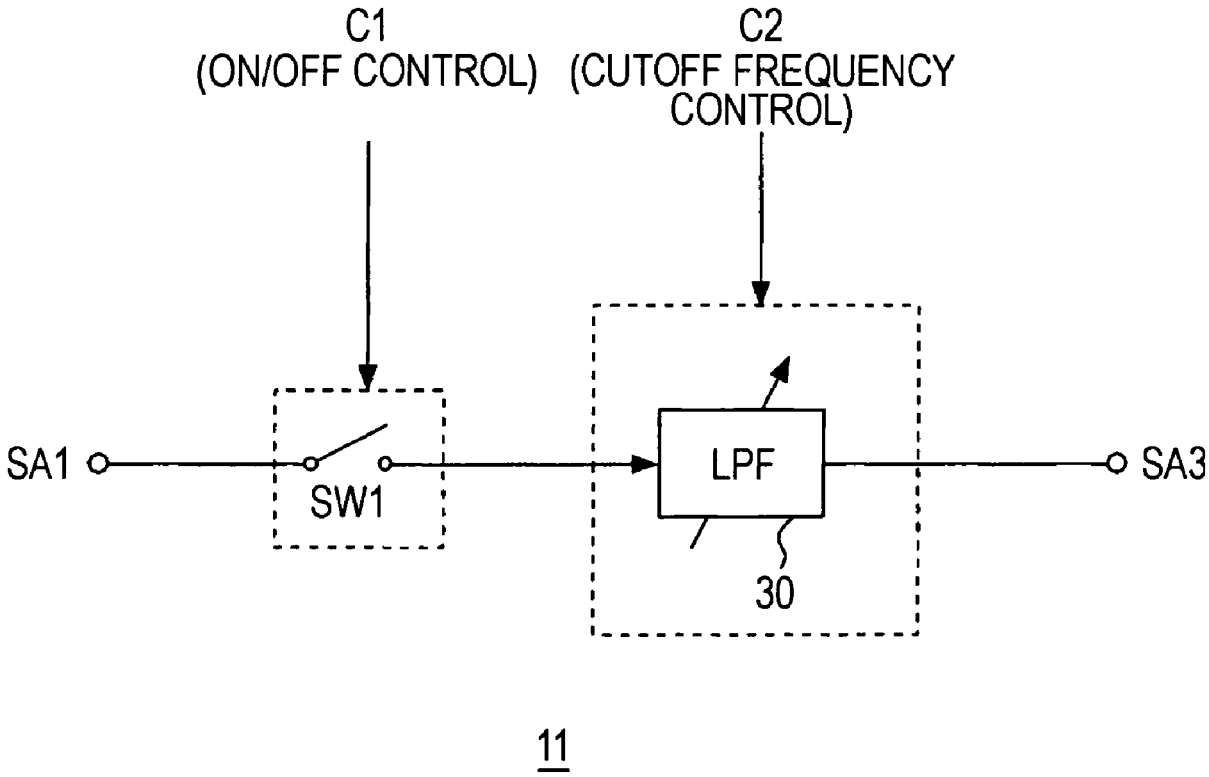
FIG. 8 is a block diagram of a bandpass tunable filter unit according to an embodiment.

The bandpass tunable filter unit 11 includes, for example, a switch SW1 and a bandpass tunable LPF 30, as shown in FIG. 8. The switch SW1 is turn on or off by a control signal C1 from a spectrum analysis/control unit 4. The cutoff frequency of the bandpass tunable LPF 30 is variably set by a control signal C2 from the spectrum analysis/control unit 4.

The output from the bandpass tunable LPF 30 is supplied to a pitch shift unit 7 as an audio signal SA3 of a frequency band subjected to a pitch shifting.

At the pitch shift unit 7, a pitch shift signal SA3' acquired by pitch shifting the audio signal SA3 at to at least a second harmonic overtone is generated and output to the combining unit 8.

With reference to the configuration shown in FIG. 8, frequency-band-component extracting unit of the claims corresponds to the bandpass tunable filter unit 11.

Also in the second embodiment, the spectrum analysis/control unit 4 carried out the processing illustrated in FIG. 4.

When the process in FIG. 4 proceeds to Step F107 when it is determined that masking does not occur, the spectrum analysis/control unit 4 carries out pitch shifting non-execution control in which the switch SW1 of the bandpass tunable filter unit 11 is turned off and the pitch shift unit 7 is prohibited from carrying out pitch shifting operation by a control signal C3.

Therefore, in such a case, the audio signal SA1 from the audio reproduction unit 5 is directly output from the combining unit 8 as a speaker output audio signal SA4 (SA4=SA1).

When the process of the spectrum analysis/control unit 4 proceeds to Step F105 when the road noise level is high and it is determined that masking is likely to occur, the frequency band to be subjected to pitch shifting is determined on the basis of the result of spectrum analysis, and pitch shifting execution control is carried out in Step F106.

In other words, in such a case, the control signal C1 turns on the switch SW1 of the bandpass tunable filter unit 11, shown in FIG. 2, and the control signal C2 instructs the cutoff frequency of the bandpass tunable LPF 30. Then, the control signal C3 instructs the pitch shift unit 7 to execute pitch shifting operation.

The audio signal SA3 of the low frequency band extracted by the bandpass tunable LPF 30 is supplied to the pitch shift unit 7. The pitch shift unit 7 generates a pitch shift signal SA3' from the audio signal SA3 and outputs the pitch shift signal SA3' to the combining unit 8.

Therefore, in such a case, the combining unit 8 additively combines the audio signal SA1 shown in FIG. 5C and the pitch shift signal SA3' shown in FIG. 5F. The result is output to the speaker 15 as an audio signal SA4.

The difference with the first embodiment is that the audio signal SA4 (SA4=SA1+SA3') for speaker output is generated by adding the pitch shift signal SA3' to the audio signal SA1 of all frequency bands including the frequency ban din which masking is likely to occur.

The same advantages as the first embodiment can also be achieved by the second embodiment.

Third Embodiment

A third embodiment will be described with reference to FIG. 9. The components that are the same as those in FIG. 1 will be represented by the same reference numerals, and descriptions thereof will not be repeated.

Figure 9:
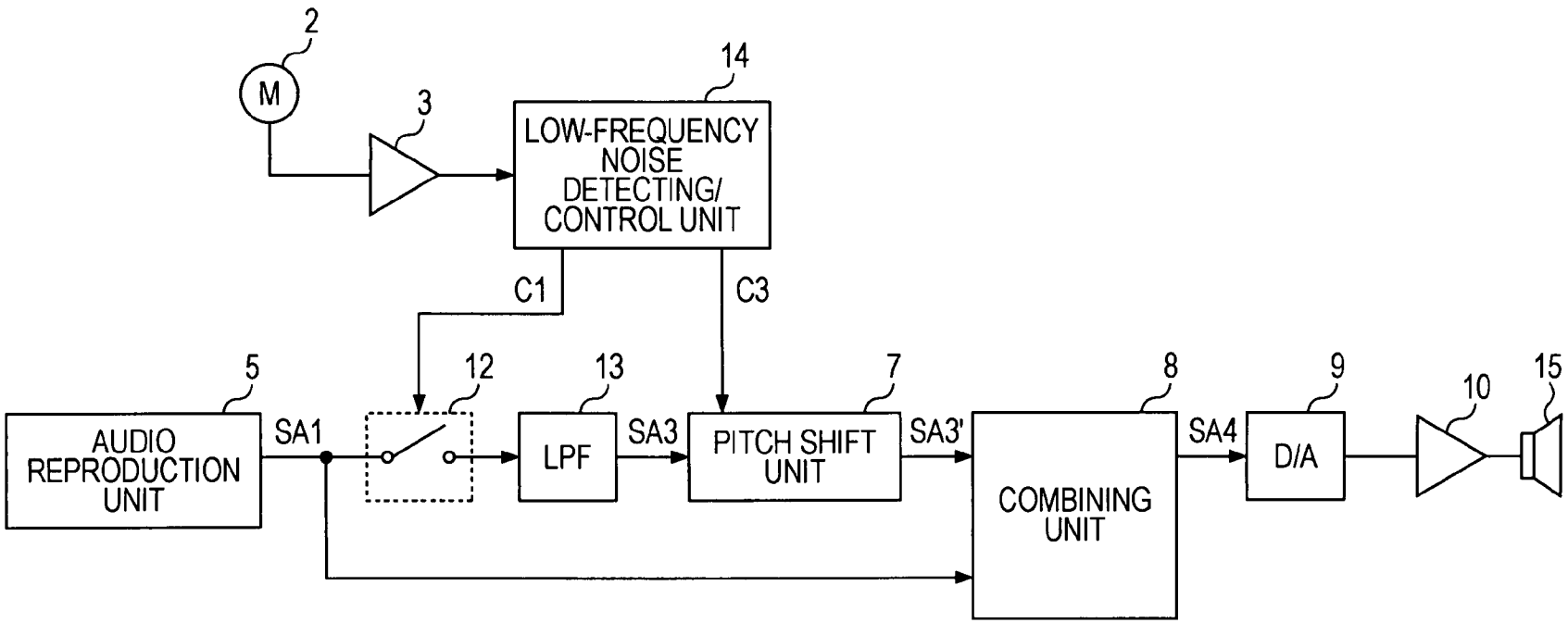
FIG. 9 is a block diagram of an audio apparatus according to a third embodiment of the present invention.

The configuration illustrated in FIG. 9 is the same as that illustrated in FIG. 1, except that a low-band noise detection/control unit 14 is provided instead of the spectrum analysis/control unit 4. The low-band noise detection/control unit 14 is a section that performs simple spectral analysis. The low-band noise detection/control unit 14 extracts only the low frequency band of the noise audio signal collected at a microphone 2 using an LPF having a cutoff frequency of a specific frequency fx and detects the noise level of the extracted frequency band. Then, the low-band noise detection/control unit 14 determines whether or not masking has occurred according to the detected noise level.

An audio signal SA1 from an audio reproduction unit 5 is supplied to a combining unit 8 and, when a switch 12 is turned on, is supplied to a pitch shift unit 7 via an LPF 13. The LPF 13 has a fixed cutoff frequency of frequency fx.

In such a case, the low-band noise detection/control unit 14 detects the noise level in a frequency band below the frequency fx. Then, according to the detected result, when the noise level in the low frequency band is low and it is determined that masking will not occur, the switch 12 is turned off by a control signal C1. Furthermore, a control signal C3 prohibits the pitch shift unit 7 from carrying out pitch shifting.

Therefore, in such a case, the audio signal SA1 from the audio reproduction unit 5 is directly output from the combining unit 8 as an audio signal SA4 (SA4=SA1).

Alternatively, when the road noise level is high and it is determined that the low-band noise level increases, causing masking to occur, the low-band noise detection/control unit 14 turns on the switch 12 by the control signal C1 and instructs the pitch shift unit 7 to carry out pitch shifting by the control signal C3.

In this way, the low-band audio signal SA3 extracted by the LPF 13 is supplied to the pitch shift unit 7. Then, the pitch shift unit 7 generates a pitch shift signal SA3' from the audio signal SA3 and outputs the pitch shift signal SA3' to the combining unit 8.

Therefore, in such a case, the combining unit 8 additively combines the audio signal SA1 and the pitch shift signal SA3' and outputs the result as an audio signal SA4 to the speaker 15.

In other words, the third embodiment simplifies the configuration and processing by fixing the frequency band of the audio signal SA3 supplied to the pitch shift unit 7.

For example, the frequency band in which the low-band noise detection/control unit 14 carries out level detection is fixed to 100 Hz and lower, and the cutoff frequency of the LPF 13 is fixed to 100 Hz. In this way, when masking occurs in the frequency band of 100 Hz and lower, the same advantages as those achieved in the first and second embodiments can be achieved by pitch shifting and adding the frequency band of the audio signal SA1.

By fixing the frequency band to be pitch shifted, fine control corresponding to the actual noise level may not be carried out. However, it is suitable for achieving the advantages of the first and second embodiments by a simple configuration.

The present invention is not limited to the first, second, and third embodiments described above, and various modifications and applications thereof may be made.

The present invention is applied to an audio apparatus used in a vehicle. In addition, the present invention may be suitably applied to an audio system used under environments with noise, such as audio apparatuses used in an aircraft or a train and audio apparatuses installed in factories and shops.

It should be understood by those skilled in the art that various modifications, combinations, sub-combinations and alterations may occur depending on design requirements and other factors insofar as they are within the scope of the appended claims or the equivalents thereof.

What is claimed is:

1. An audio output apparatus comprising:

a masking band determining unit configured to determine a first frequency band in which masking due to environmental sounds is likely to occur in audio signal output sounds;

a band-component extracting unit configured to extract a signal component from an input audio signal in the first frequency band determined by the masking band determining unit;

a pitch shift unit configured to perform pitch shifting of the signal component in the first frequency band extracted by the band-component extracting unit and generate a pitch shift signal containing a signal component of at least a doubled frequency; and a signal output unit configured to supply an audio signal containing the pitch shift signal acquired by the pitch shift unit to a connected speaker.

2. The audio output apparatus according to claim 1, wherein the band-component extracting unit separates the signal component of the first frequency band and a signal component of a second frequency band and supplies the signal component of the first frequency band to the pitch shift unit, and the signal output unit supplies an audio signal acquired by combining the signal component of the second frequency band and the pitch shift signal to a speaker.

3. The audio output apparatus according to claim 1, wherein the band-component extracting unit extracts the signal component of the first frequency band from an input audio signal and supplies the extracted signal component to the pitch shift unit, and the signal output unit supplies an audio signal acquired by combining the input audio signal and the pitch shift signal to a speaker.

4. The audio output apparatus according to claim 1, wherein the masking band determining unit carries out frequency analysis of environmental noise collected by a microphone and carries out determination of the first frequency band on the basis of an environmental noise level of each frequency band.

5. The audio output apparatus according to claim 1, wherein the pitch shift unit generates the pitch shift signal containing a signal component of at least a doubled frequency of the frequency of the signal component of the first frequency band and another harmonic component.

6. An audio output apparatus comprising:

a masking determining unit configured to determine whether or not masking due to environmental sounds occurs to audio signal output sounds;

a band-component extracting unit configured to extract a signal component of a specific frequency band from an input audio signal when the masking determining unit determines that masking occurs;

a pitch shift unit configured to perform pitch shifting of a signal component in a first frequency band extracted by the band-component extracting unit and generates a pitch shift signal containing a signal component of at least a doubled frequency; and a signal output unit configured to supply an audio signal containing the pitch signal acquired by the pitch shift unit to a connected speaker.

7. An audio output method comprising the steps of:

determining a first frequency band in which masking due to environmental sounds is likely to occur in audio signal output sounds;

extracting a signal component in the first frequency band from an audio signal;

performing pitch shifting of the signal component in the extracted first frequency band and generating a pitch shift signal containing a signal component of at least a doubled frequency; and supplying an audio signal containing the pitch shift signal to a connected speaker.

* * * * *